US008523344B2

(12) United States Patent
Mitsunaga

(10) Patent No.: US 8,523,344 B2
(45) Date of Patent: Sep. 3, 2013

(54) IMAGE RECORDING APPARATUS AND CONTROLLING METHOD FOR THE SAME

(75) Inventor: Osamu Mitsunaga, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 356 days.

(21) Appl. No.: 12/947,969

(22) Filed: Nov. 17, 2010

(65) Prior Publication Data

US 2011/0122188 A1 May 26, 2011

(30) Foreign Application Priority Data

Nov. 25, 2009 (JP) ..... 2009-267844

(51) Int. Cl.
*B41J 2/01* (2006.01)

(52) U.S. Cl.
USPC ..... 347/101; 347/16; 347/33

(58) Field of Classification Search
USPC ..... 347/22–36, 16, 101
See application file for complete search history.

(56) References Cited

U.S. PATENT DOCUMENTS

| | | | | |
|---|---|---|---|---|
| 7,399,056 | B2 * | 7/2008 | Nakashima et al. | 347/29 |
| 2008/0231655 | A1 * | 9/2008 | Yamada | 347/30 |
| 2008/0316253 | A1 * | 12/2008 | Inuoe | 347/33 |
| 2010/0156983 | A1 * | 6/2010 | Tamaki | 347/16 |
| 2010/0182371 | A1 * | 7/2010 | Tomoguchi | 347/32 |

FOREIGN PATENT DOCUMENTS

| | | | |
|---|---|---|---|
| JP | 2000-141814 | A | 5/2000 |
| JP | 2005-199606 | A | 7/2005 |

OTHER PUBLICATIONS

Japanese Office Action dated Jul. 16, 2013 (and English translation thereof) in counterpart Japanese Application No. 2009-267844.

* cited by examiner

*Primary Examiner* — Julian Huffman
*Assistant Examiner* — Sharon A Polk
(74) *Attorney, Agent, or Firm* — Holtz, Holtz, Goodman & Chick, PC

(57) ABSTRACT

When a jam occurs, a jam position detection unit detects a position of a record medium stuck in an image recording apparatus. A restoration mechanism control unit determines whether or not to move a restoration mechanism on the basis of the position of the stuck record medium.

12 Claims, 7 Drawing Sheets

IMAGE RECORDING APPARATUS AND CONTROLLING METHOD FOR THE SAME

CROSS-REFERENCE TO RELATED APPLICATION

This application is based upon and claims the benefit of priority of the prior Japanese Patent Application No. 2009-267844, filed on Nov. 25, 2009, the entire contents of which are incorporated herein by reference.

BACKGROUND OF THE INVENTION

1. Field of the Invention

Some embodiments according to the present invention relate to an image recording apparatus that records an image on a record medium using ink, and particularly relate to a method for controlling a restoration mechanism at power shutdown of an image recording apparatus.

2. Description of Related Art

An inkjet technique is one of the recording forms of image recording apparatuses, such as printers, copy machines and FAX machines. Image recording apparatuses using an inkjet technique record an image by ejecting ink from a plurality of nozzles provided at recording heads to a record medium, such as paper or film.

For such an image recording apparatus using an inkjet technique, when image recording is not being performed, it is necessary to cap the nozzle surface of a recording head in order to prevent paper dust and dirt from adhering to the nozzle and the nozzle surface from becoming dried out. In addition, when image recording is not being performed, it is also necessary to move an ink receiving member to a position at which it faces the nozzle in order to prevent the transportation path from becoming stained due to dripping of ink from the nozzle. Therefore, these processes are performed by image recording apparatuses using an inkjet technique when they are in a power shutdown state or in a power-saving mode under which image recording is stopped.

Meanwhile, an image recording apparatus repeatedly feeds, transports, and discharges recording media. When these operations are performed, a so-called jam may occur in which a record medium is stuck in the transportation path. When a jam occurs, the user needs to remove the record medium causing the jam and restart the image recording; however, sometimes, the apparatus switches over to a power-saving mode or shuts down the power while in a jam state.

As an example, in regard to a technology for performing an initializing process for a printer caught in a paper jam at the turning on of the main power supply, Japanese Laid-open Patent Publication No. 2000-141814 (hereinafter referred to as "patent document 1" and incorporated herein by reference) discloses an initializing method of a printer.

The printer in patent document 1 performs a paper ejection process before the initializing process, using information from a paper sensor for sensing paper on the paper path and a home sensor for sensing whether the carriage is at the home position or not. In this way, when an initializing process is performed while paper is jammed on the paper path, a carriage error which would occur via the jammed paper touching the carriage is prevented from occurring.

SUMMARY OF THE INVENTION

An image recording apparatus according to one embodiment of the present invention, which records an image by ejecting ink while a record medium fed from a feed mechanism is being transported by a transportation belt, includes: a recording head comprising a nozzle that ejects ink onto the record medium; a restoration mechanism movable to a remote position and a restoration process position facing the recording head; a jam position detection unit for detecting the position of a stuck record medium when a record medium jam occurs; and a restoration mechanism control unit for determining whether or not to move the restoration mechanism from the retracted position to the restoration process position on the basis of the position of the stuck record medium when a request to operate the restoration mechanism is received while the record medium is jammed.

A control method for an image recording apparatus according to one embodiment of the present invention, which records an image by ejecting ink while a record medium fed from a feed mechanism is being transported by a transportation belt, comprises: detecting the position of a stuck record medium when a record medium jam occurs; and, when a request to operate a restoration mechanism movable to a retracted position and a restoration process position facing a recording head comprising a nozzle that ejects ink to a record medium is received while the record medium is jammed, determining whether or not to move the restoration mechanism from the retracted position to the restoration process position on the basis of the position of the stuck record medium.

BRIEF DESCRIPTION OF THE DRAWINGS

The present invention will be more apparent from the following detailed description when the accompanying drawings are referenced.

DESCRIPTION OF THE PREFERRED EMBODIMENTS

Next, embodiments of the present invention will be described in detail with reference to the drawings.

In the following, an exemplary situation will be described in which an image recording apparatus of the present embodiment is configured as an full-line type color image recording apparatus. In the full-line type color image recording apparatus, recording heads have a plurality of nozzles for ink ejection which are arranged in a direction (main scanning direction) orthogonal to the transportation direction (sub-scanning direction) in which record media are transported, the recording heads are arranged in the sub-scanning direction in such a way that they are spaced from each other, and each of the recording heads corresponds to a different color. Such an image recording apparatus records characters and images by positioning record media on which images are recorded so that they face a plurality of head nozzles at the recording heads and by ejecting ink of certain colors from the head nozzles to the record media.

It should be noted that the image recording apparatus of the present embodiment is not limited to being a full-line type color image recording apparatus, but can use another recording system as long as it comprises a nozzle that ejects ink to record images. In addition, it is not limited to being an image recording apparatus that performs recording by ejecting ink of a plurality of colors, but may also be an image recording apparatus that records images by ejecting ink of a single color.

In the following description, the transportation direction of record media is defined as a sub-scanning direction and the direction orthogonal to the transportation direction is defined as a main scanning direction.

First, a configuration of the image recording apparatus of the present embodiment will be described.

Figure 1:
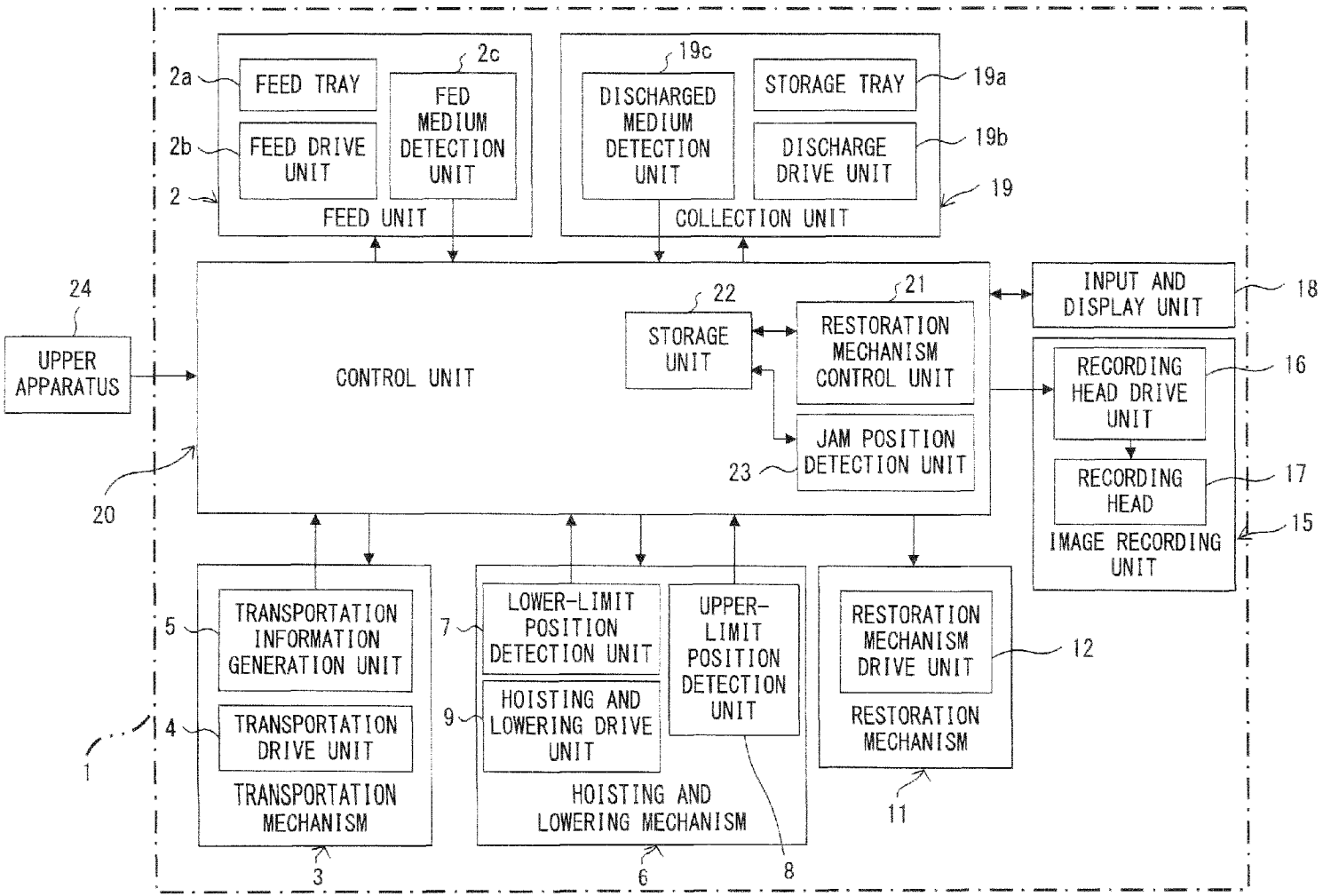
FIG. 1 is a diagram showing an exemplary configuration of an image recording apparatus according to the present embodiment.
Figure 2:
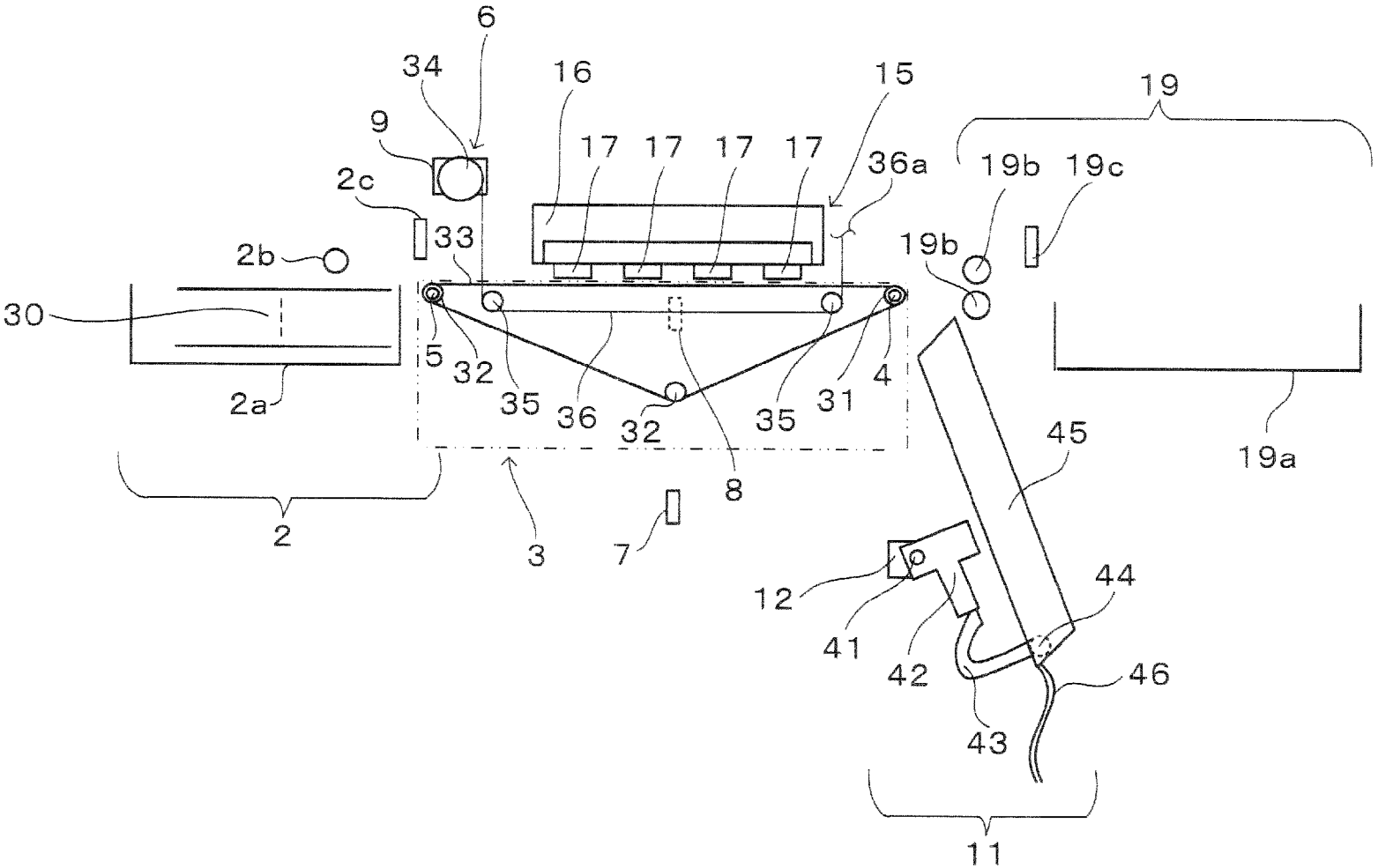
FIG. 2 is a diagram showing a position example of a feed unit, transportation mechanism, restoration mechanism, image recording unit, and collection unit of the image recording apparatus according to the present embodiment.

FIG. 1 shows an exemplary configuration of an image recording apparatus according to the present embodiment. FIG. 2 shows a position example of a feed unit, transportation mechanism, restoration mechanism, image recording unit, and collection unit of the image recording apparatus according to the present embodiment.

An image recording apparatus 1 of the present embodiment performs a recording process by ejecting ink from recording heads 17 having a plurality of nozzles to a record medium 30 while the record medium 30 is being transported on a transportation path.

The image recording apparatus 1 of the present embodiment comprises a control unit 20, a feed unit 2, a transportation mechanism 3, a hoisting and lowering mechanism 6, a restoration mechanism 11, an image recording unit 15, and a collection unit 19.

The control unit 20 controls the entirety of the image recording apparatus 1. The feed unit 2 feeds and transports the record medium 30 to the transportation mechanism 3. The transportation mechanism 3 transports the record medium passed from the feed unit 2. The image recording unit 15 records an image on the record medium transported by the transportation mechanism 3. The collection unit 19 discharges and stores a record medium on which an image was recorded. The hoisting and lowering mechanism 6 moves the transportation mechanism 3 to an upper-limit position (i.e., recording position) when image recording is performed and moves the restoration mechanism 11 placed on the transportation mechanism 3 to a restoration process position when a restoration process is performed.

Next, each element of the image recording apparatus 1 will be further described.

The control unit 20 has a storage unit 22 and a processing circuit (not shown) composed of an MPU (Micro Processor Unit) with a control function and calculation function. The storage unit 22 comprises: a nonvolatile memory region for saving a control program, a set value relating to control of the image recording apparatus, and the like; and a memory (e.g., random access memory (RAM)) for temporarily storing image record information. The control unit 20 controls each element of the image recording apparatus 1 via the MPU reading a control program from the nonvolatile memory region and executing it. When such a control is performed, the control unit 20 also functions as a restoration mechanism control unit 21 and jam position detection unit 23.

Instead of causing the control unit 20 to function as the restoration mechanism control unit 21 and jam position detection unit 23 by causing the MPU to execute a control program, the control unit 20 can also be provided with a restoration mechanism control unit 20 and jam position detection unit 23 configured as signal processing circuits (hardware) controlled by the MPU.

The feed unit 2 comprises: a feed tray 2*a* for accommodating sheet-like record media 30; a feed drive unit 2*b* for touching the uppermost one of the record media 30 accommodated in the feed tray 2*a* so as to remove the record media 30 one by one, and for passing them to the transportation mechanism 3 side; and a fed medium detection unit 2*c* for sensing the fed recording media 30.

The feed tray 2*a* is composed of, for example, a so-called feed cassette and the like. The feed drive unit 2*b* is composed of, for example, a feed roller. The fed medium detection unit 2*c* comprises one of, for example, an optical transmission sensor, an optical reflection-type sensor, an electrostatic capacitance type sensor, and the like, and detects, for example, the front end edge or rear end edge of the record medium 30 transported in the sub-scanning direction of the record medium 30.

As shown in FIG. 2, the transportation mechanism 3 is provided so that the transportation surface faces ink ejection ports of the plurality of recording heads 17. In the frame of the transportation mechanism 3, a drive roller 31, a follower roller 32, and a transportation drive unit 4 for rotating the drive roller 31 are arranged in the sub-scanning direction and spaced away from each other, and a looped transportation belt 33 covers these rollers so that it can rotate. In the frame of the transportation mechanism 3, a transportation information generation unit 5 and at least one suction fan (not shown) are provided.

At a position upstream from the recording heads 17 in the transportation direction, the transportation information generation unit 5 is provided so that it is coaxial with the follower roller 32. The transportation information generation unit 5 comprises, for example, an encoder and the like, detects a movement state of the transportation belt 33, and generates an encoder pulse signal as transportation information such as transportation timing. The suction fan (not shown) generates a negative pressure so as to adsorb the record medium 30 on the transportation belt 33.

As shown in FIG. 2, the hoisting and lowering mechanism 6 moves up and down the transportation mechanism 3. The hoisting and lowering mechanism 6 comprises a reel roller 34, a hoisting and lowering drive unit 9, hoisting and lowering follower rollers 35, wire (cable) 36, a lower-limit position detection unit 7, and an upper-limit position detection unit 8. The reel roller 34 reels the wire 36 when the transportation mechanism 3 is moved up. The hoisting and lowering drive unit 9 drives the reel roller 34. The hoisting and lowering follower rollers 35, placed at the four corners of the transportation mechanism 3, suspend the transportation mechanism 3 using the wire 36. One end of the wire 36 is connected to the reel roller 34 and the other end (i.e., wire end 36*a*) is connected to the frame of the image recording apparatus (not shown), and the wire 36 is composed of, for example, a wire. The lower-limit position detection unit 7 senses the arrival of the transportation mechanism 3 at the lower-limit position. The upper-limit position detection unit 8 senses the arrival of the transportation mechanism 3 at the upper-limit position (i.e., recording position). The lower-limit position detection unit 7 and upper-limit position detection unit 8 are composed of, for example, an optical transmission sensor, optical reflection-type sensor, or the like, and they report detection information to the control unit 20.

Figure 3A:
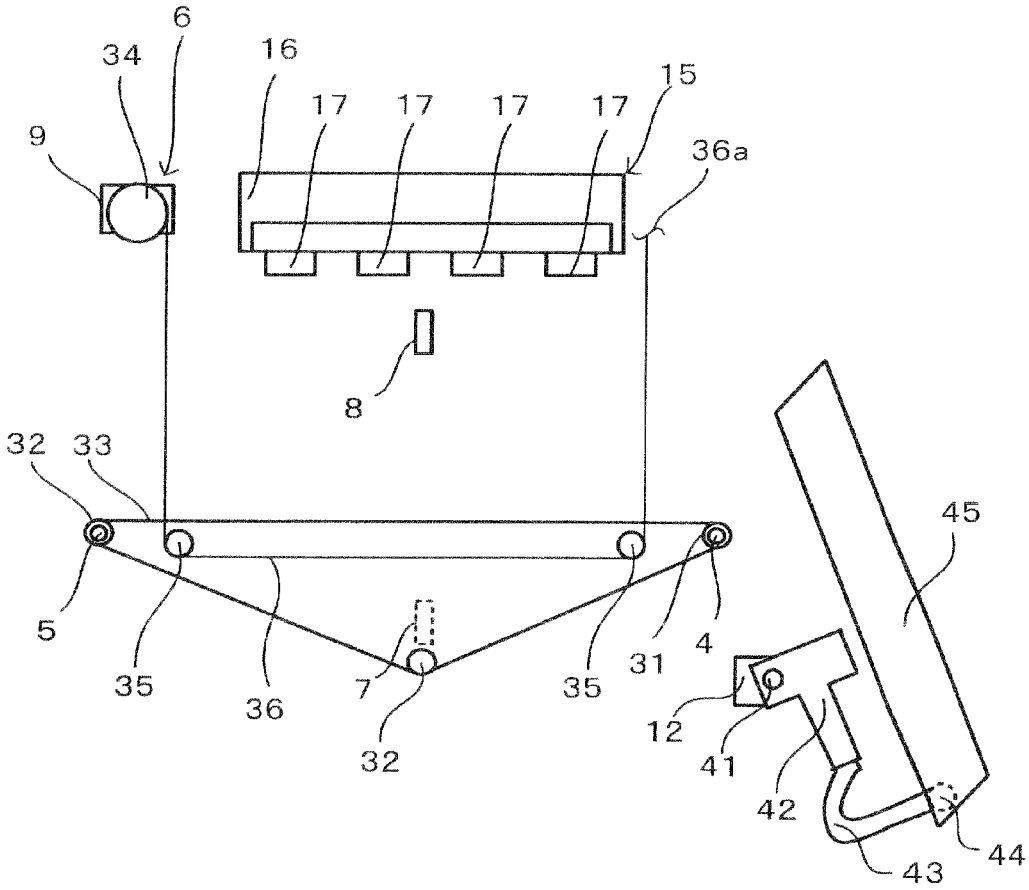
FIGS. 3A and 3B are each a diagram (pattern 1) showing a position example of a transportation mechanism, restoration mechanism, and image recording unit of the image recording apparatus according to the present embodiment.
Figure 3B:
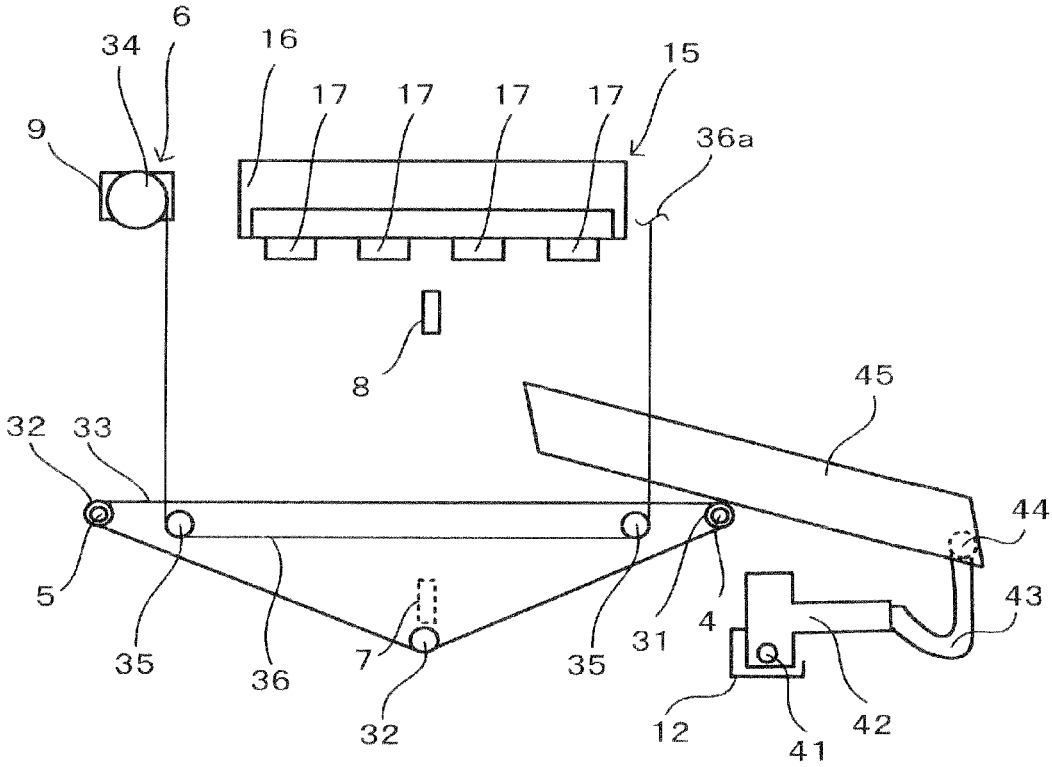
Figure 4A:
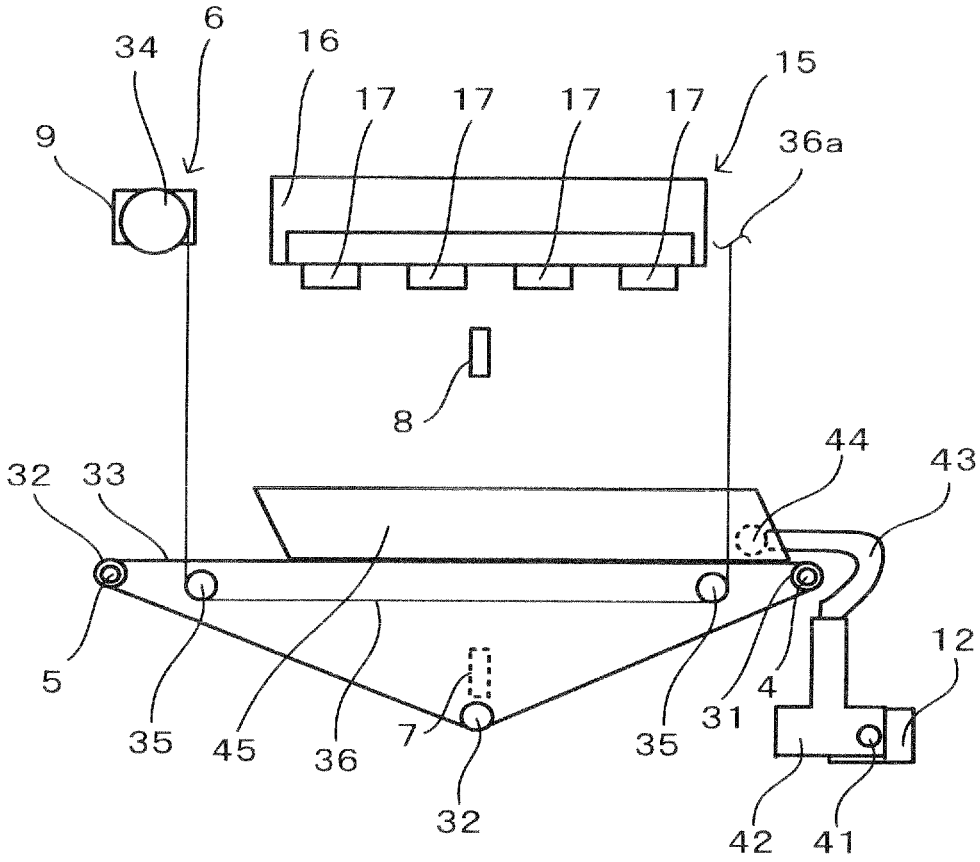
FIGS. 4A and 4B are each a diagram (pattern 2) showing a position example of a transportation mechanism, restoration mechanism, and image recording unit of the image recording apparatus according to the present embodiment.
Figure 4B:
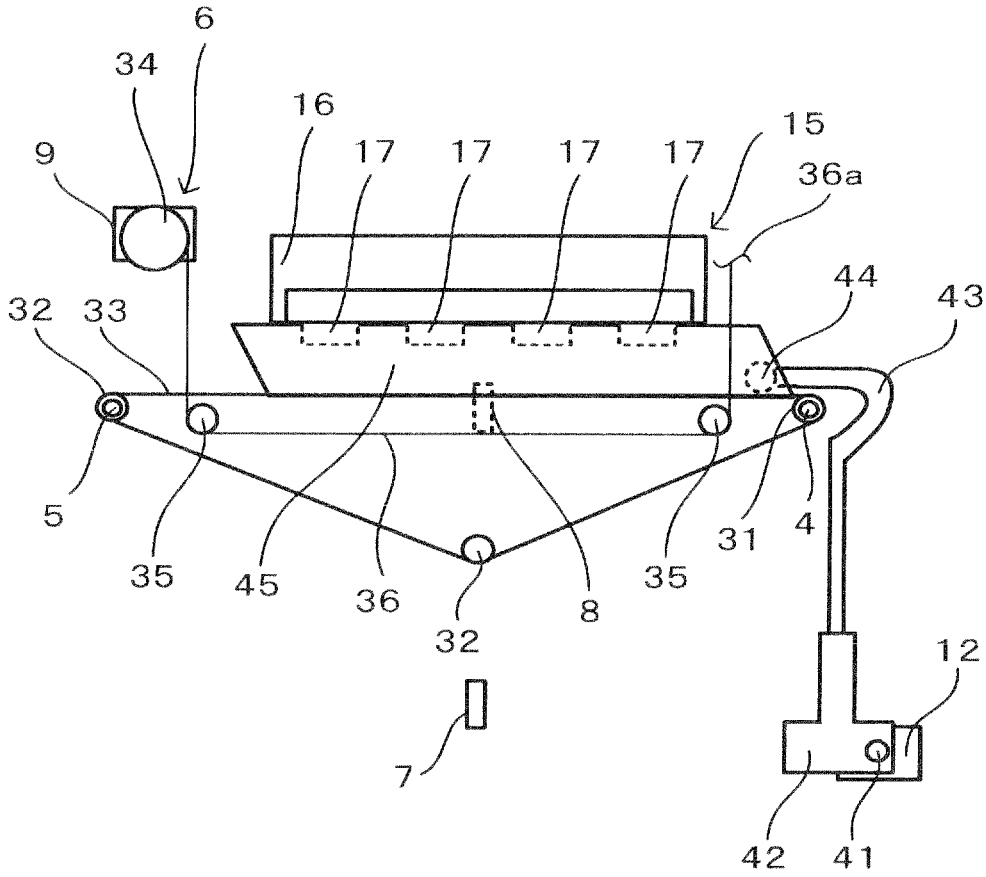

As shown in FIGS. 2, 3A, 3B, 4A and 4B, the restoration mechanism 11 can be placed at a retracted position (FIGS. 2 and 3A), can move toward the transportation mechanism 3 (FIG. 3B), can be placed on the transportation mechanism 3 (FIG. 4A), and can be placed at the restoration process position (FIG. 4B).

The restoration mechanism 11 comprises a restoration mechanism drive unit 12, a restoration mechanism drive axis 41, a restoration mechanism guide 42, a restoration mechanism arm 43, an ink receiver axis 44, an ink receiver 45, and a waste liquid tube 46.

As will be described below, the restoration mechanism drive unit 12 moves the ink receiver 45 from the retracted position to the restoration process position. The restoration mechanism drive axis 41 joins the restoration mechanism drive unit 12 and the restoration mechanism guide 42 together. The restoration mechanism guide 42 covers the restoration mechanism arm 43 and is connected to be rotated by the restoration mechanism drive axis 41. The restoration mechanism arm 43 and the restoration mechanism guide 42 form a dual structure, and have a telescopic configuration. The ink receiver 45 receives ink ejected from the recording heads 17 when a restoration process is performed. The ink receiver axis 44 joins the restoration mechanism arm 43 and the ink receiver 45 together. The ink receiver 45 comprises, for example, a resin, and can keep ink inside itself. The ink receiver 45 has a wipe member (not shown) inside itself, and the wipe member wipes away ink adhering to the recording heads 17 by moving in the main scanning direction. The waste liquid tube 46 sends ink kept in the ink receiver 45 to a waste liquid tank (not shown).

The image recording unit 15 comprises recording heads 17 and a recording head drive unit 16.

The recording heads 17 provide a plurality of nozzles for ejecting ink that are arranged linearly. The recording heads 17 are arranged so that they cover a width that is greater than the maximum record medium width based on the design, and can be controlled using a drive signal so that each of the nozzles individually ejects ink. Using a control signal output from the control unit 20 on the basis of recording data, the recording head drive unit 16 outputs to the recording heads 17 drive signals that drive each of the nozzles of the recording heads 17.

Users use an input and display unit 18 in order to give instructions regarding various settings and regarding an activate request of a restoration operation. The input and display unit 18 also notifies the user of the fact that recording is currently being performed and notifies the user of an error and the like. The input and display unit 18 is configured with a so-called operation panel and the like.

A collection unit 19 is configured with a storage tray 19*a*, discharge drive units 19*b*, and a di charged medium detection unit 19*c*.

The storage tray 19*a* accommodates a discharged record medium 30 and is configured with a so-called accommodation tray and the like. The discharge drive units 19*b* discharge the record medium 30 transported by the transportation mechanism 3 and are configured with, for example, discharge rollers. The discharged medium detection unit 19*c* is configured with, for example, an optical transmission sensor, an optical reflection-type sensor, an electrostatic capacitance type sensor, or the like, and detects the rear end of the discharged record medium 30 directed in the sub-scanning direction of the record medium 30. If necessary, the discharged medium detection unit 19*c* may be configured so as to also detect the front end of the record medium 30.

The control unit 20 controls the feed unit 2, transportation mechanism 3, hoisting and lowering mechanism 6, restoration mechanism 11, image recording unit 15, and collection unit 19 so that they perform an image recording process on the record medium 30. The control unit 20 comprises at least the restoration mechanism control unit 21, storage unit 22, and jam position detection unit 23.

The restoration mechanism control unit 21 controls the movements of the restoration mechanism 11 onto the transportation mechanism 3 and to the retracted position. In the present embodiment, by causing the MPU of the control unit 20 to read a predetermined control program from a nonvolatile memory of the control unit 20 and to execute it, the control unit 20 functions as the restoration mechanism control unit 21.

The storage unit 22 functions as a nonvolatile memory region for saving a control program, a set value relating to control of the image recording apparatus, and the like, and functions as, for example, a RAM for temporarily storing image record information.

When the record medium 30 is jammed while being transported in order to record an image, the jam position detection unit 23 detects the occurrence of the jam and reports to the control unit 20 the position of the record medium 30 stuck in the image recording apparatus 1.

As external equipment of the image recording apparatus 1 according to the present embodiment, an upper apparatus 24 is connected via, for example, a LAN (Local Area Network) or the like. The upper apparatus 24 corresponds to a computer that causes the image recording apparatus 1 according to the present embodiment to perform a recording process and that is operated by the user. As information relating to a recording process, the upper apparatus 24 reports job information to the image recording apparatus 1 according to the present embodiment.

The job information includes recording data for performing a recording process on the record medium 30, information indicating the size of the record medium 30, designation information of margin values of the margins that appear when a recording process is performed on the record medium 30 and that extend in the main scanning direction and sub-scanning direction, and designation information of the number of the record media 30 on which recording processes are performed. When the control unit 20 of the image recording apparatus 1 receives job information reported from the upper apparatus 24, it causes the storage unit 22 to store the job information as image record information.

Next, an image recording process performed on the record medium 30 by the image recording apparatus 1 will be described in detail.

When job information is reported from the upper apparatus 24 and when the transportation mechanism 3 is not at the upper-limit position (i.e., recording position), the control unit 20 instructs the hoisting and lowering drive unit 9 of the hoisting and lowering mechanism 6 to hoist the transportation mechanism 3.

When the hoisting and lowering drive unit 9 performs driving, the wire 36 is wound by the reel roller 34. The transportation mechanism 3 is hoisted via the wire 36 being wound, and when it is hoisted to the upper-limit position, the upper-limit position detection unit 8 reports to the control unit 20 that the transportation mechanism 3 was detected. Then, the control unit 20 causes the hoisting and lowering drive unit 9 to stop.

Next, when the control unit 20 controls the transportation drive unit 4 of the transportation mechanism 3 so as to rotate the drive roller 31, the transportation belt 33 starts to be driven.

Next, the control unit 20 controls the feed unit 2 so as to cause the feed drive unit 2*b* to pick up the record media 30 one at a time from the feed tray 2*a*, and sends them to the transportation mechanism 3 side.

Subsequently, the front end of the record medium 30 is detected by the fed medium detection unit 2*c* placed downstream from the feed unit 2, and the fed medium detection unit 2 outputs an edge signal. When the control unit 20 receives the edge signal, it advances the control process using this edge signal as a trigger signal for generating recording process timing.

The record medium 30 is adsorbed on and transported by the transportation belt 33 of the transportation mechanism 3. In accordance with this transportation, an encoder pulse signal is output from the transportation information generation unit 5 to the control unit 20.

The encoder pulse signal is used as transportation information of the record medium 30 and is also used as a synchronous signal used when the recording heads 17 record an image. In advance, as a pulse number of the encoder pulse signal, the control unit 20 stores in the storage unit 22 the timing of starting ink ejection from the nozzles. The control unit 20 controls the image recording unit 15 at the timing at which the pulse number above is identical with the pulse number of the encoder pulse signal generated by the transportation information generation unit 5. In accordance with the control performed by the control unit 20, the image recording unit 15 causes the nozzle of the recording heads 17 to eject ink onto the record medium 30 adsorbed on the transportation belt 33.

On the basis of image record information stored by the storage unit 22, the control unit 20 outputs to the recording head drive unit 16 recording data of each line, which is used for performing an image recording process. On the basis of the recording data, the recording head drive unit 16 controls the recording heads 17 so as to perform a recording process on the record medium 30.

After an image recording process is performed in this way, the record medium 30 is passed to the collection unit 19 provided downstream from the transportation mechanism 3. Then, the record medium 30 is held between the discharge drive units 19*b* and is transported downstream. Subsequently, the rear end of the record medium 30 is detected (edge detection) by the discharged medium detection unit 19*c*, and the record medium 30 is then stored in the storage tray 19*a*.

Next, operations performed when the record medium 30 is jammed while the image recording apparatus 1 is performing an image recording process will be described.

In the image recording process described above, in accordance with the detection of the front end of the record medium 30 by the fed medium detection unit 2*c*, the control unit 20 performs counting until the transportation information generation unit 5 generates a predetermined number of pulses. If the front end of the record medium 30 is not detected by the discharged medium detection unit 19*c* during this counting operation, the control unit 20 determines that the record medium 30 in the process of being transported is jammed somewhere on the transportation belt 33.

The control unit 20, determining that the record medium 30 is jammed, gives an instruction to stop the transportation drive unit 4 of the transportation mechanism 3 and the discharge drive units 19*b* of the collection unit 19, and gives an instruction to stop the feed drive unit 2*b* of the feed unit 2 if another record medium 30 follows.

At this moment, the record medium 30 is jammed; for example, a record medium 30 stuck on the transportation belt 33 is caught between the transportation belt 33 and the recording heads 17, and cannot be moved in this situation.

Therefore, the control unit 20 instructs the hoisting and lowering drive unit 9 of the hoisting and lowering mechanism 6 to lower the transportation mechanism 3. When the hoisting and lowering drive unit 9 performs driving in accordance with this instruction, the reel roller 34 rotates and unreels the wire 36. Via the wire 36 being unreeled, the transportation mechanism 3 is lowered. When the transportation mechanism 3 is lowered to the lower-limit position, the lower-position detection unit 7 reports to the control unit 20 that the transportation mechanism 3 was detected. Upon receiving this report, the control unit 20 stops the hoisting and lowering drive unit 9.

Then, the control unit 20 causes the display unit 18 to indicate that a jam has occurred so as to urge the user to remove the record medium 30 stuck in the image recording apparatus.

Here, a situation has been described in which the jammed record medium 30 is stuck on the transportation belt 33; however, by performing similar operations, it is also possible to address jams which occur at the feed unit 2 and collection unit 19 which will be illustrated in the following.

As an example, assume that the record medium 30 is fed by driving the feed drive unit 2*b* of the feed unit 2 but the fed medium detection unit 2*c* does not detect the rear end of the record medium 30. This is a situation in which a predetermined time period has passed since the fed medium detection unit 2*c* detected the front end of the record medium 30, or a situation in which the rear end of the record medium 30 has not been detected yet even after a predetermined number of pulses of the transportation information generation unit 5 were counted. In this situation, since it is possible that the rear end of the record medium 30 is at the feed tray 2*a* side and the front end of the record medium 30 is on the transportation belt 33, it will be easier to remove the record medium 30 if the transportation mechanism 3 is lowered to the lower-limit position.

As another example, assume that after the record medium 3530 is recorded on the transportation belt 33 by the recording heads 17, it is transported to the collection unit 19, but the discharged medium detection unit 19*c* of the collection unit 19 does not detect the rear end of the record medium 30. This is a situation in which a predetermined time period has passed since the discharged medium detection unit 19*c* detected the front end of the record medium 30, or a situation in which the rear end of the record medium 30 has not been detected yet even after a predetermined number of pulses of the transportation information generation unit 5 were counted. In this situation, the front end of the record medium 30 is on the storage tray 19*a* side or is seen from the storage tray 19*a* side; however, since it is possible that the rear end of the record medium 30 is on the transportation belt 33, it will be easier to remove the record medium 30 if the transportation mechanism 3 is lowered to the lower-limit position.

It is not necessary to lower the transportation mechanism 3 to the lower-limit position in order to address a jam at the feed unit 2, which will be illustrated in the following.

As an example, when the record medium 30 is fed by driving the feed drive unit 2*b* of the feed unit 2 and when the front end of the record medium 30 is not detected by the fed medium detection unit 2*c*, the record medium 30 is located upstream from the fed medium detection unit 2*c*. In this situation, therefore, the record medium 30 can be removed even when the transportation mechanism 3 is not at the lower-limit position.

In the descriptions of jams above, situations were described as examples in which a jam occurs while an image is being recorded on one record medium; in fact, however, image recording may also be performed on a plurality of record media. In such a situation, it is possible that record media 30 positioned before and after the position at which a jam has occurred will also be stuck in the image recording apparatus. Therefore, when a jam occurs, the control unit 20 also detects the positions of all record media 30 stuck in the image recording apparatus.

Next, a restoration process performed by the recording heads 17 in the image recording apparatus 1 will be described in connection with the operation of the restoration mechanism.

When an instruction, to perform a restoration process is given via the input and display unit 18 and when the transportation mechanism 3 is not located at the lower-limit position, the control unit 20 instructs the hoisting and lowering drive unit 9 of the hoisting and lowering mechanism 6 to lower the transportation mechanism 3. When the hoisting and lowering drive unit 9 performs driving, the reel roller 34 rotates and unreels the wire 36. This causes the transportation mechanism 3 to be lowered, and when it is lowered to the lower-limit position, the lower-limit position detection unit 7 reports to the control unit 20 that the transportation mechanism 3 was detected. Upon receiving this report, the control unit 20 stops the hoisting and lowering drive unit 9.

Next, the control unit 20 instructs the restoration mechanism control unit 21 to move the restoration mechanism 11 onto the transportation mechanism 3. Upon receiving this instruction, the restoration mechanism control unit 21 drives the restoration mechanism drive unit 12 of the restoration mechanism 11.

FIGS. 3A, 3B, 4A and 4B show position examples of the transportation mechanism, restoration mechanism, and image recording unit of the image recording apparatus 1 of the present embodiment.

FIG. 3A shows a condition in which the restoration mechanism 11 is at a retracted position. Under this condition, when the restoration mechanism control unit 21 drives the restoration mechanism drive unit 12, the restoration mechanism guide 42 and restoration mechanism arm 43 rotate around the restoration mechanism drive axis 41. Because of this, the ink receiver 45 leans against the transportation mechanism 3 at a slant. This condition is shown in FIG. 3B.

Under the condition shown in FIG. 3B, when the restoration mechanism drive unit 12 further performs driving, the ink receiver 45 will be loaded on the transportation mechanism 3. This condition is shown in FIG. 4A.

Under the condition shown in FIG. 4A, the control unit 20 instructs the hoisting and lowering drive unit 9 of the hoisting and lowering mechanism 6 to hoist the transportation mechanism 3.

When the hoisting and lowering drive unit 9 performs driving, the wire 36 is wound by the reel roller 34, and this hoists the transportation mechanism 3 and the restoration mechanism 11 on the transportation mechanism 3. Then, when the ink receiver 45 of the restoration mechanism 11 is in contact with the image recording unit 15, the control unit 20 causes the hoisting and lowering drive unit 9 to stop. At this moment, the restoration mechanism 11 is at a restoration operation position and covers the recording heads 17. The restoration mechanism arm 43 extends from the restoration mechanism guide 42. In addition, the recording heads 17 for all colors are covered with the ink receiver 45. This condition is shown in FIG. 45.

Under the condition shown in FIG. 45, the control unit 20 instructs the recording head drive unit 16 to eject ink, and the recording head drive unit 16 causes the recording heads 17 to eject ink. The ejected ink is kept in the ink receiver 45 and a portion of the ejected ink adheres to the surfaces of the recording heads 17. Accordingly, the control unit 20 wipes away the ink on the surfaces of the recording heads 17 by moving a wipe member (not shown) in the ink receiver 45 in the main scanning direction. Then, the wiped ink is kept in the ink receiver 45.

When the process described above is completed, the control unit 20 instructs the hoisting and lowering drive unit 9 of the hoisting and lowering mechanism 6 to lower the transportation mechanism 3. When the hoisting and lowering drive unit 9 performs driving in accordance with this instruction, the reel roller 34 rotates and the wire 36 is unreeled. Via the wire 36 being unreeled, the transportation mechanism 3 and the restoration mechanism 11 on the transportation mechanism 3 are lowered, and when the transportation mechanism 3 is lowered to the lower-limit position, the lower-limit position detection unit 7 reports to the control unit 20 that the transportation mechanism 3 was detected. Upon receiving this report, the control unit 20 causes the hoisting and lowering drive unit 9 to stop. At this moment, the restoration mechanism arm 43 of the restoration mechanism 11 is stored by the restoration mechanism guide 42. This condition is shown in FIG. 4A.

Then, the control unit 20 instructs the restoration mechanism control unit 21 to move the restoration mechanism 11 on the transportation mechanism 3 to the retracted position. When the restoration mechanism control unit 21 drives the restoration mechanism drive unit 12 of the restoration mechanism 11 upon receiving this instruction, the restoration mechanism guide 42 and restoration mechanism arm 43 rotate around the restoration mechanism drive axis 41. Because of this, the ink receiver 45 moves toward the retracted position and leans against the transportation mechanism 3 at a slant. This condition is shown in FIG. 3B.

When the restoration mechanism drive unit 12 further performs driving, the ink receiver 45 moves from the transportation mechanism 3 to the retracted position. This condition is shown in FIG. 3A. At this moment, ink kept in the ink receiver 45 flows through the waste liquid tube 46 into a waste liquid tank (not shown).

As described above, the restoration process of the recording heads 17 is performed via the restoration mechanism 11 moving to the restoration operation position.

Next, operations performed when the image recording apparatus 1 switches over to the standby mode, switches over to the low power consumption mode, or shuts down the power will be described. Here, operations of the transportation mechanism 3 and restoration mechanism 11 are not described in detail since they are the same as the operations of these mechanisms performed in the restoration process described above.

The standby mode is an operation mode for protecting the recording heads when a recording process or the like is not performed for a predetermined time period. When the image recording apparatus 1 is in the standby mode, the ink temperature regulation and the like are the same as those in a waiting state in a normal image recording operation so that image recording can be started as soon as the upper apparatus 24 makes a request for the control unit 20 to record an image.

The low power consumption mode is an operation mode in which the control unit 20 can receive a request to record an image from the upper apparatus 24 but other functions are stopped so that, as much as possible, power is not consumed.

When the image recording apparatus switches over to the standby mode or low power consumption mode or when the user shuts down the power via the input and display unit 18, the control unit 20 first moves the transportation mechanism 3 to the lower-limit position if the transportation mechanism 3 is not already located at the lower-limit position.

Then, the control unit 20 instructs the restoration mechanism control unit 21 to move the restoration mechanism 11 onto the transportation mechanism 3. Upon receiving this instruction, the restoration mechanism control unit 21 drives the restoration mechanism drive unit 12 so as to load the ink receiver 45 on the transportation mechanism 3 as shown in FIG. 4A.

Subsequently, the control unit 20 hoists the transportation mechanism 3 so as to cover the recording heads 17 for all colors as shown in FIG. 4B with the ink receiver 45.

In this way, it is possible to prevent the head nozzle surfaces of the recording heads 17 from becoming dried out. In addition, even when ink drips from the head nozzle of the recording head 17 for some reason, it is possible to prevent the transportation belt 33 from becoming stained.

Next, operations performed by the image recording apparatus 1 when the record medium 30 is jammed and when the image recording apparatus 1 switches over to the standby mode, switches over to the low power consumption mode, or shuts down the power will be described.

As described above, a jam can occur at the feed unit 2, transportation mechanism 3, and collection unit 19, and the record medium 30 can be stuck at one or more of these parts. As an example, when a jam occurs on the transportation mechanism 3, the jammed record medium 30 is stuck on the transportation mechanism 3. Under this condition, if switching over to the standby mode or low power consumption mode is performed or if the power is shut down as described above, the ink receiver of the restoration mechanism 11 pushes the jammed record medium 30 back to the feed unit 2 side when the ink receiver 45 of the restoration mechanism 11 is loaded on the transportation mechanism 3.

Depending on the condition of the jammed record medium 30, the jammed record medium 30 might be in contact with the recording head 17 due to the movement of the ink receiver 45, and this might damage the nozzle surface of the recording head 17. In addition, the jammed record medium 30 might be in contact with the fed medium detection unit 2 of the feed unit 2, and this might damage the fed medium detection unit 2*c*. Alternatively, a fault might occur in which the jammed record medium 30 is caught by the feed drive unit 2*b*, and it will be difficult to remove it. If these things occur, the next recording process will be adversely affected.

Accordingly, when a request to switch over to the standby mode or low power consumption mode or a request to shut down the power is made while a jam is occurring, the control unit 20 determines whether or not to perform the operation of the restoration mechanism 11 in accordance with the position of the stuck record medium 30.

As an example, when at least one of the stuck record media 30 is on the transportation belt 33 or at a position at which it is in contact with the ink receiver 45 of the restoration mechanism 11, the operation of the restoration mechanism 11 is not performed.

As another example, when the record media 30 are stuck only upstream from the fed medium detection unit 2*c*, the operation of the restoration mechanism 11 is performed.

Needless to say, the operation of the restoration mechanism 11 is not performed when the restoration mechanism 11 cannot be operated due to an error (e.g., when an error occurs causing the restoration mechanism drive unit 12 to be inoperable) or when the transportation mechanism 3 cannot move to the lower-limit position.

As described above, by determining whether the restoration mechanism 11 is operable or not in accordance with the position of the jammed and stuck record medium 30, it is possible to prevent the image recording apparatus 1 from failing due to the stuck record medium 30 being in contact with the ink receiver 45. By moving, as much as possible, the ink receiver 45 to a position at which it faces the recording heads, it is also possible to prevent the nozzle surfaces of the recording heads 17 from becoming dried out. In addition, even when ink drips from the head nozzle of the recording head 17 for some reason, it is also possible to prevent the transportation belt 33 from becoming stained.

Next, details of an operation process performed when the image recording apparatus 1 of the present embodiment switches over to the standby mode or low power consumption mode or when it receives a power shutdown request will be described with reference to FIG. 5.

Figure 5:
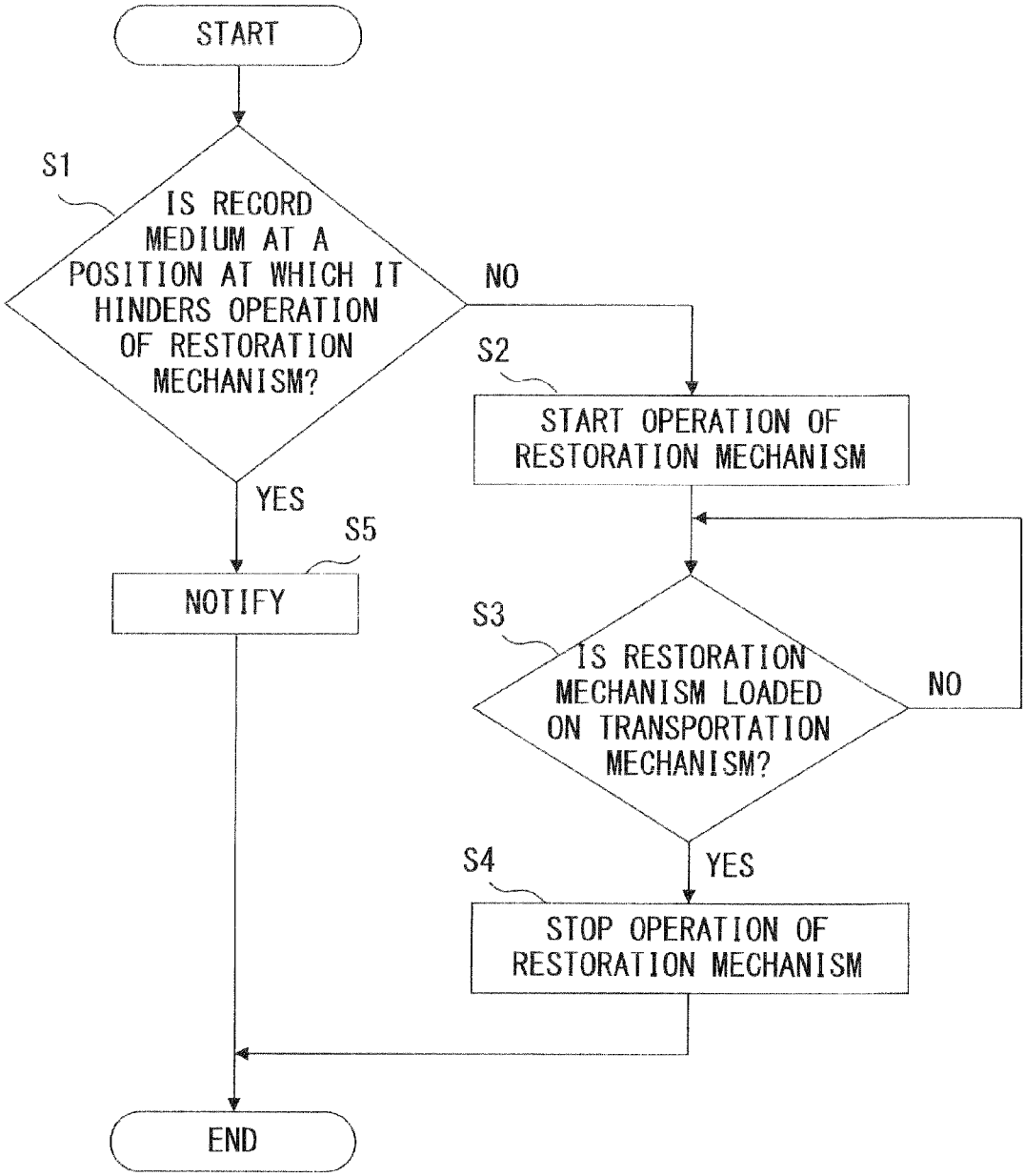
FIG. 5 is a flowchart indicating a control process performed by a control unit 20 when the image recording apparatus according to the present embodiment switches over to a standby mode, switches over to a low power consumption mode, or receives a power shutdown request.

FIG. 5 is a flowchart indicating a control process performed by a control unit 20 when the image recording apparatus 1 of the present embodiment switches over to the standby mode, switches over to the low power consumption mode, or receives a power shutdown request.

The process shown in FIG. 5 is achieved via an MPU reading and executing a control program which is stored in advance in the nonvolatile memory region of the storage unit 22. Via the MPU executing the control program, the control unit 20 functions as the restoration mechanism control unit 21 and jam position detection unit 23.

As an example, the control unit 20 receives a power shutdown request from the input and display unit 18, and performs a lower-limit position movement, process of the transportation mechanism 3 when it is not at the lower-limit position. After this, when the control unit 20 moves the restoration mechanism 11 to the retracted position, it starts the control process in FIG. 5.

When the image recording apparatus switches over to the standby mode, switches over to the low power consumption mode, or receives a power shutdown request, the control unit 20 first performs in step S1 a process for determining whether or not there is a record medium 30 stuck at a position at which it hinders the operation of the restoration mechanism 11.

In this case, when the control unit 20 determines that there is a record medium 30 stuck at a position at which it hinders the operation of the restoration mechanism 11 (step S1, YES), the process proceeds to step S5 without the operation of the restoration mechanism 11 being performed. After such a notification is made in step S5 to the user by sound or display using the input and display unit 18, the process is terminated.

By contrast, when the control unit 20 determines in step S1 that there is not a record medium 30 stuck at a position at which it hinders the operation of the restoration mechanism (step S1, NO), the control unit 20 drives in step S2 the restoration mechanism drive unit 12 of the restoration mechanism 11.

Then, in step S3, the control unit 20 waits for the ink receiver 45 of the restoration mechanism 11 to rotate and to be loaded on the transportation mechanism 3 as shown in FIG. 4A (step S3, NO). When the control unit 20 determines that the ink receiver 45 of the restoration mechanism 11 has been loaded on the transportation mechanism 3 (step S3, YES), it stops in step S4 the operation of the restoration mechanism drive unit 12 of the restoration mechanism 11 and terminates the process.

As described above, when the image recording apparatus 1 of the present embodiment switches over to the standby mode or low power consumption mode or receives a power shutdown request, it checks before operating the restoration mechanism 11 whether a record medium 30 is stuck at a position at which it hinders the operation of the restoration mechanism 11. If the record medium 30 is stuck at a position at which it hinders the operation of the restoration mechanism 11, such a notification is made to the user without the restoration mechanism 11 being moved, and then the process is terminated. Accordingly, even without removing a jammed record medium, it is possible to prevent a fault from occurring in which the stuck record medium 30 damages portions of the image recording apparatus 1 when the ink receiver 45 of the restoration mechanism 11 is moved.

When it is determined that the restoration mechanism 11 is operable, it is possible to move the ink receiver 45 to a position at which it faces the recording heads so as to prevent the transportation path from becoming stained when ink drips from the recording head to the transportation path.

As described above, when the image recording apparatus 1 of the present embodiment receives a request to operate the restoration mechanism while a jam is occurring, it determines whether or not to move the restoration mechanism in accordance with the stagnating state of the record medium. Therefore, it is possible to prevent a stuck record medium from damaging the image recording apparatus when the restoration mechanism is caused to run. Via the control unit 20 determining that the restoration mechanism is movable and via the restoration mechanism being moved to the restoration process position on the basis of the determination, it is also possible to prevent the transportation path from becoming stained due to ink dripping from the recording head to the transportation path.

The present invention can form various embodiments by appropriately combining a plurality of elements disclosed in each of the embodiments. As an example, some elements can be removed from an entire configuration indicated in an embodiment, and in addition, elements indifferent embodiments can be appropriately combined.

Embodiments of the present invention are not limited to the embodiments disclosed herein. In implementation phases of embodiments of the present invention, they can be realized while varying, adding, or removing some elements without departing from the scope of the invention.

What is claimed is:

1. An image recording apparatus which records an image by ejecting ink to a record medium fed from a feed mechanism while the record medium is being transported by a transportation belt, the apparatus comprising:

a recording head including a nozzle that ejects ink onto the record medium;

a restoration mechanism which is movable to a retracted position and to a restoration process position facing the recording head, wherein the restoration mechanism is loaded on the transportation belt when the restoration mechanism is located at the restoration process position;

a jam position detection unit for detecting a position of a stuck record medium when a record medium jam occurs; and a restoration mechanism control unit for determining whether or not to move the restoration mechanism from the retracted position to the restoration process position based on the position of the stuck record medium when a request to operate the restoration mechanism is received while the record medium is jammed.

2. The image recording apparatus according to claim 1, wherein when the stuck record medium is at a position at which the stuck record medium would contact the restoration mechanism while the restoration mechanism moves to the restoration process position, the restoration mechanism control unit determines to not move the restoration mechanism from the retracted position to the restoration process position.

3. The image recording apparatus according to claim 1, wherein when the stuck record medium is positioned on the transportation belt, the restoration mechanism control unit determines to not move the restoration mechanism from the retracted position to the restoration process position.

4. The image recording apparatus according to claim 1, wherein when the stuck record medium is stuck upstream from the feed mechanism in a transportation direction, the restoration mechanism control unit determines to move the restoration mechanism from the retracted position to the restoration process position.

5. The image recording apparatus according to claim 1, wherein the request to operate the restoration mechanism includes at least one of a request to cause the image recording apparatus to switch over to a standby mode or low power consumption mode and a request to shut down the image recording apparatus.

6. The image recording apparatus according to claim 1, wherein when the restoration mechanism is at the restoration process position, the restoration mechanism is at a position at which the restoration mechanism receives ink from the nozzle.

7. The image recording apparatus according to claim 1, wherein the restoration mechanism comprises a wiping unit for wiping away ink adhering to the recording head.

8. The image recording apparatus according to claim 7, wherein when the restoration mechanism moves to the restoration process position, the wiping unit wipes away ink on the recording head.

9. A control method for an image recording apparatus which records an image by ejecting ink to a record medium fed from a feed mechanism while the record medium is being transported by a transportation belt, wherein the image recording apparatus comprises a recording head including a nozzle that ejects ink onto the record medium, and a restoration mechanism which is movable to a retracted position and to a restoration process position facing the recording head, the method comprising:

detecting a position of a stuck record medium when a record medium jam occurs; and when a request to operate the restoration mechanism is received while the record medium is jammed, determining whether or not to move the restoration mechanism from the retracted position to the restoration process position based on the position of the stuck record medium, wherein the restoration mechanism is loaded on the transportation belt when the restoration mechanism is located at the restoration process position.

10. The control method according to claim 9, wherein, when the stuck record medium is at a position at which the stuck record medium would contact the restoration mechanism while the restoration mechanism moves to the restoration process position, it is determined not to move the restoration mechanism from the retracted position to the restoration process position.

11. The control method according to claim 9, wherein, when the stuck record medium is positioned on the transportation belt, it is determined not to move the restoration mechanism from the retracted position to the restoration process position.

12. The control method according to claim 9, wherein, when the stuck record medium is stuck upstream from the feed mechanism in a transportation direction, it is determined to move the restoration mechanism from the retracted position to the restoration process position.

* * * * *